US010161122B2

(12) United States Patent
Liu

(10) Patent No.: US 10,161,122 B2
(45) Date of Patent: Dec. 25, 2018

(54) TWIN WATER-DRAINAGE VALVE INNER CORE TUBE STARTING APPARATUS

(71) Applicant: LAB (XIAMEN) SANITARY FITTINGS INC, Xiamen (CN)

(72) Inventor: Yongmao Liu, Xiamen (CN)

(73) Assignee: LAB (XIAMEN) SANITARY FITTING INC, Xiamen, Fujian (CN)

( * ) Notice: Subject to any disclaimer, the term of this patent is extended or adjusted under 35 U.S.C. 154(b) by 79 days.

(21) Appl. No.: 15/030,379

(22) PCT Filed: Nov. 13, 2013

(86) PCT No.: PCT/CN2013/087025

§ 371 (c)(1),
(2) Date: Apr. 19, 2016

(87) PCT Pub. No.: WO2015/070391

PCT Pub. Date: May 21, 2015

(65) Prior Publication Data

US 2016/0273201 A1 Sep. 22, 2016

(51) Int. Cl.

| | |
|---|---|
| ***E03D 1/14*** | (2006.01) |
| ***E03D 3/04*** | (2006.01) |
| ***E03D 1/34*** | (2006.01) |

(52) U.S. Cl.

CPC ..... *E03D 1/142* (2013.01); *E03D 1/14* (2013.01); *E03D 1/34* (2013.01); *E03D 3/04* (2013.01)

(58) Field of Classification Search

CPC .. E03D 1/142; E03D 1/34; E03D 1/14; E03D 1/35; E03D 3/12

(Continued)

(56) References Cited

U.S. PATENT DOCUMENTS 4,566,140 A * 1/1986 Musgrove ..... E03D 1/145 4/324
5,205,000 A * 4/1993 Xia ..... E03D 1/144 4/324

(Continued)

FOREIGN PATENT DOCUMENTS

CN 201411751 Y * 2/2010 ..... E03D 1/34

OTHER PUBLICATIONS

Written Opinion of the International Searching Authority for PCT/CN2013/087025.*
Machine Translation for CN 201411751.*

*Primary Examiner* — Erin Deery
(74) *Attorney, Agent, or Firm* — Leong C. Lei

(57) ABSTRACT

A twin water-drainage valve inner core tube starting apparatus includes a button seat, main body, half drainage button, full drainage button, half drainage float, full drainage float, inner core tube and lever, the half drainage float, full drainage float and inner core tube being installed inside the main body to form a half drainage structure and full drainage structure, the button seat being configured on the main body, and the half drainage button and full drainage button being mounted on the button seat, where at least two levers arranged symmetrically are mounted inside the main body, one end of the two levers is abutted against the half drainage button and full drainage button, and another end thereof is in connection with the inner core tube through a pull rod. Whereby, the present invention can reduce the water drainage pressing force and decrease the friction between the components.

4 Claims, 14 Drawing Sheets

(58) Field of Classification Search
USPC ..... 4/324–327, 410, 415, 405, 413
See application file for complete search history.

(56) References Cited

U.S. PATENT DOCUMENTS

| | | | | | |
|---|---|---|---|---|---|
| 5,659,903 | A * | 8/1997 | Hammarstedt | E03D 1/144 | 4/324 |
| 6,081,938 | A * | 7/2000 | McClure | E03D 1/142 | 4/324 |
| 6,163,897 | A * | 12/2000 | Plas | E03D 1/142 | 4/410 |
| 6,785,913 | B2 * | 9/2004 | Ho | E03D 1/142 | 4/325 |
| 2007/0163034 | A1 * | 7/2007 | Ogen | E03D 1/14 | 4/325 |

* cited by examiner

TWIN WATER-DRAINAGE VALVE INNER CORE TUBE STARTING APPARATUS

TECHNICAL FIELD OF THE INVENTION

The present invention relates to a twin water-drainage valve, and more particularly to a twin water-drainage valve inner core tube starting apparatus.

DESCRIPTION OF THE PRIOR ART

Conventional twin water-drainage valve inner core tube starting apparatuses approximately include a button seat, main body, half drainage button, full drainage button, half drainage float, full drainage float, inner core tube, lever and water sealing sheet, where the half drainage float, full drainage float and inner core tube are installed inside the main body, the button seat is configured on the main body, and the half drainage button and full drainage button are mounted on the button seat, with a half drainage pull piece and full drainage pull piece are formed correspondingly below the half drainage button and full drainage button. The lever is mounted inside the main body, one end of the lever is opposed to the half drainage pull piece and full drainage pull piece and another end thereof is in connection with the upper part of the inner core tube, and the water sealing sheet is configured on the lower part of the inner core tube. Furthermore, a half drainage raised point and full drainage raised point are formed on the inner core tube. Correspondingly, a half drainage support is configured to be in linkage with the half drainage float, and a full drainage support full drainage float.

The half drainage button is pressed down, upon half water drainage, the inner core tube is driven to lift upward through the lever until the haft drainage raised point is abutted against the half drainage support in linkage with the half drainage float, and at this time, the inner core tube is limited, the water sealing sheet is lifted, realizing the water flushing. Thereafter, the half drainage float drives the half drainage support to deflect under the action of gravity, i.e. the half drainage support is expanded outward when the water level is dropped to the half drainage float. At this time, the inner core tube is free from the abutment and therefore falls to its original position, while the water sealing sheet falls back to a drain port, and the half drainage flushing is thus completed.

The full drainage button is pressed down, upon full water drainage, the inner core tube is driven to lift upward through the lever until the full drainage raised point is abutted against the full drainage support in linkage with the full drainage float, and at this time, the inner core tube is limited, the water sealing sheet is lifted, realizing the water flushing. Thereafter, the full drainage float drives the full drainage support to deflect under the action of gravity, i.e. the full drainage support is expanded outward when the water level is dropped to the full drainage float. At this time, the inner core tube is free from the abutment and therefore falls to its original position, while the water sealing sheet falls back to the drain port, and the full drainage flushing is thus completed.

The lever of the twin water-drainage valve inner core tube starting apparatus is set to number 1, and one end of the lever is opposed to the half drainage pull piece and full drainage pull piece and another end thereof is general in connection with one side of the upper part of the inner core tube, having the disadvantages as the following:

1. because a force applied on the half drainage button or full drainage button is transmitted and acted directly on the inner core tube through the single lever, it is rather labor-consumptive upon the button pressing.
2. because the lever is in connection with one side of the upper part of the inner core tube, the inner core tube is inclined to generate friction with other components, the pressing force on the button is further increased, and the inner core tube and other components are easy to be damaged while the button is pressed to lift the inner core tube.

SUMMARY OF THE INVENTION

One object of the present invention is to provide a twin water-drainage valve inner core tube starting apparatus, capable of reducing the pressing force upon water drainage, and decreasing the friction between components.

To achieve the object mentioned above, the present invention proposes a twin water-drainage valve inner core tube starting apparatus, including a button seat, main body, half drainage button, full drainage button, half drainage float, full drainage float, inner core tube and lever, the half drainage float, full drainage float and inner core tube being installed inside the main body to form a half drainage structure and full drainage structure, the button seat being configured on the main body, and the half drainage button and full drainage button being mounted on the button seat, where at least two levers arranged symmetrically are mounted inside the main body, one end of the two levers is abutted against the half drainage button and full drainage button, and another end thereof is in connection with the inner core tube through a pull rod.

Further, the levers are set to number 2, and the two levers are arranged axially symmetrically.

Further, one end of one of the levers is formed into a U-typed groove, and one end of the other lever is inserted in the U-typed groove and then abutted against the half drainage button and full drainage button.

Further, the levers are set to number 3, and the three levers are arranged radially and each two adjacent levers are arranged symmetrically.

Further, the levers are set to number 4, and the four levers are arranged radially and symmetrically.

After the above solutions are adopted, the present invention installs at least two levers arranged symmetrically inside the main body, and one end of the levers is abutted against the half drainage button and full drainage button, and another end thereof is in connection with the inner core tube through a pull rod, having the following advantages compared with the prior art:

1. because a force applied on the half drainage button or full drainage button is transmitted and acted on the inner core tube through at least two levers, it is more labor-saving upon the button pressing.
2. because one end of the levers is abutted against the half drainage button and full drainage button and the other end thereof is in connection with the inner core tube through the pull rod, the inner core tube is no longer inclined and will not generate friction with other components, and thus, the pressing force is reduced and the inner core tube and other components will not be damaged.

DETAILED DESCRIPTION OF THE PREFERRED EMBODIMENTS

Figure 1:
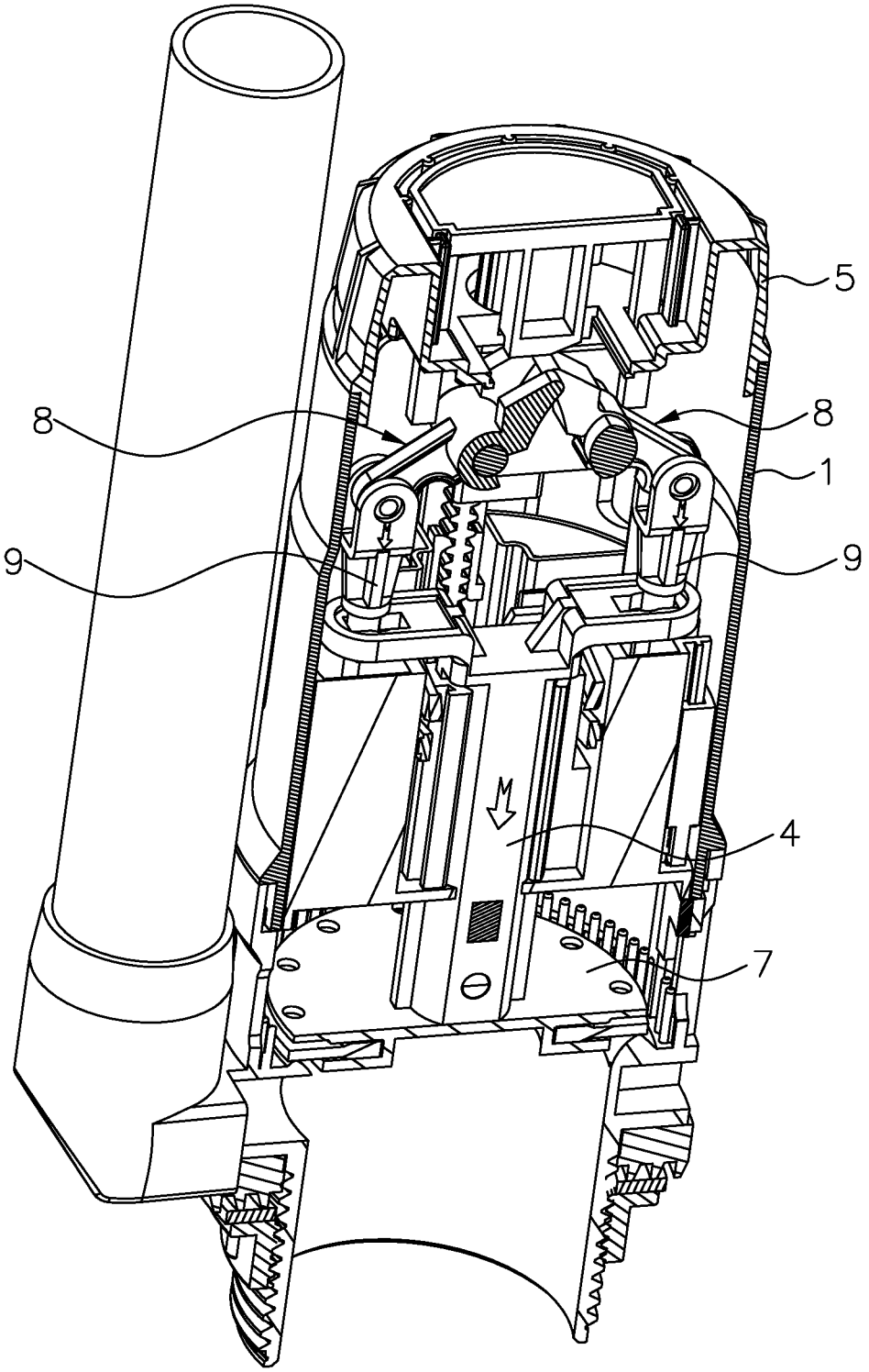
FIG. 1 is a cross-sectional view of a preferred embodiment of the present invention in a static state.
Figure 2:
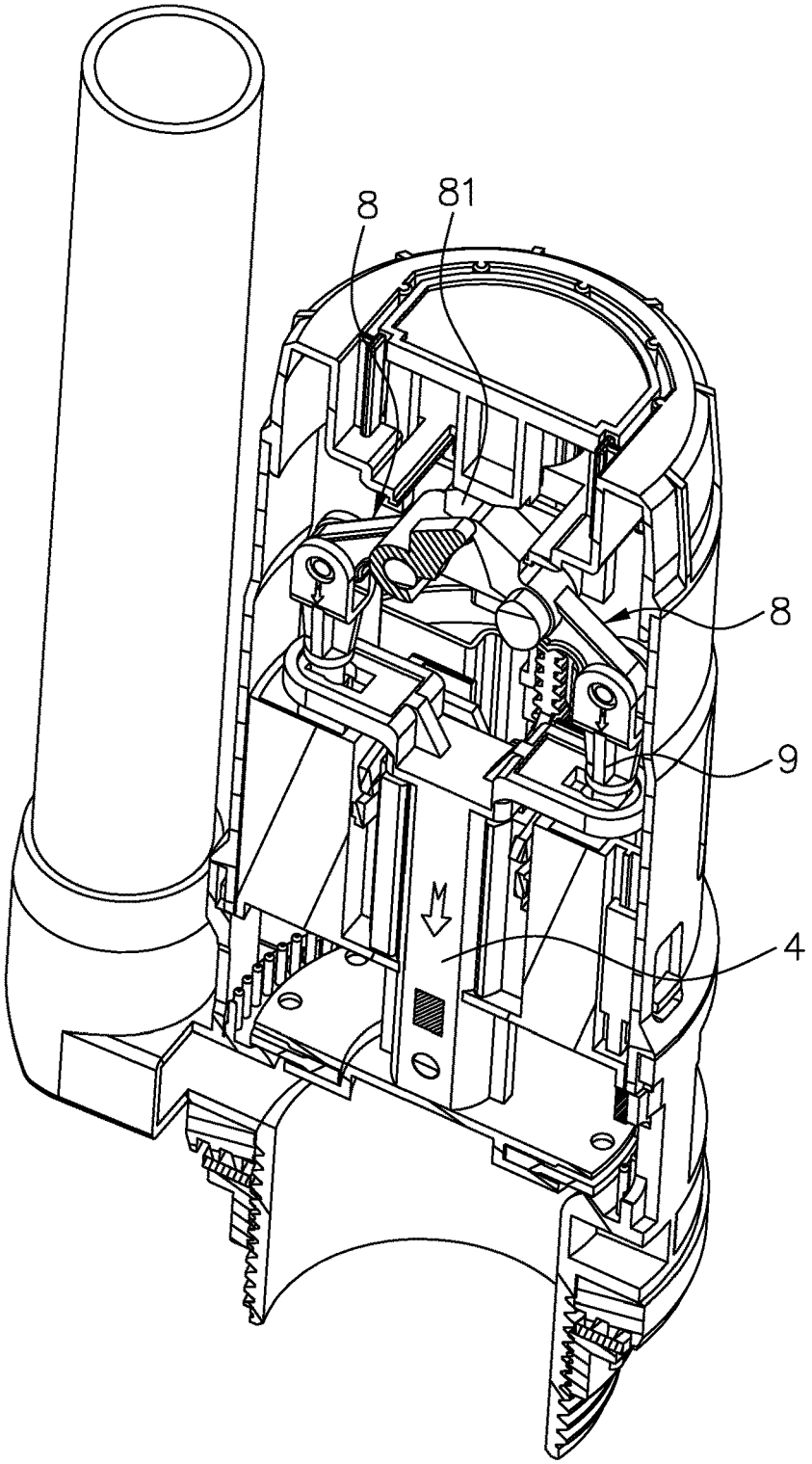
FIG. 2 is a cross-sectional view of the embodiment of the present invention viewing from another angle.
Figure 3:
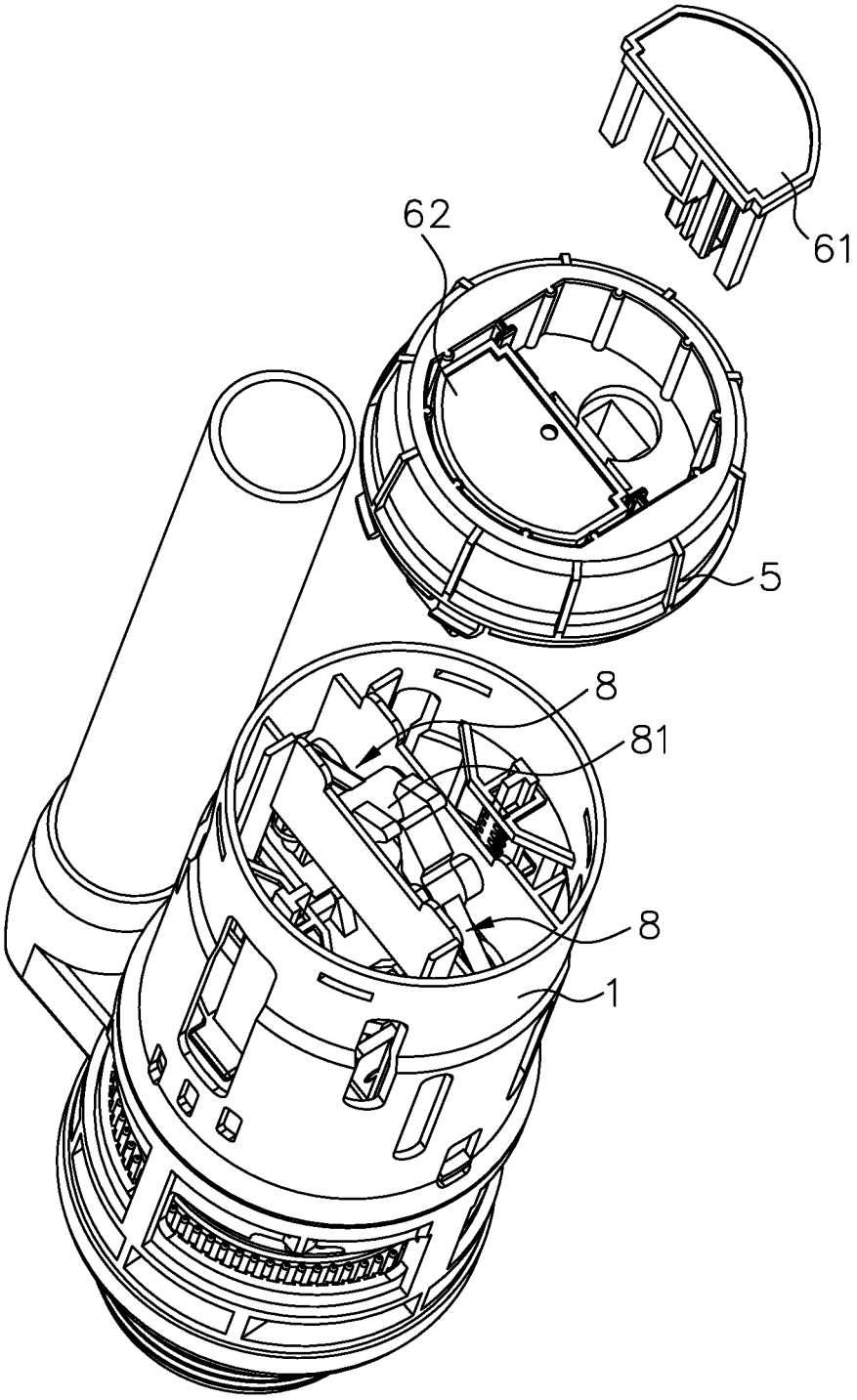
FIG. 3 is a partly exploded view of the embodiment of the present invention.
Figure 4:
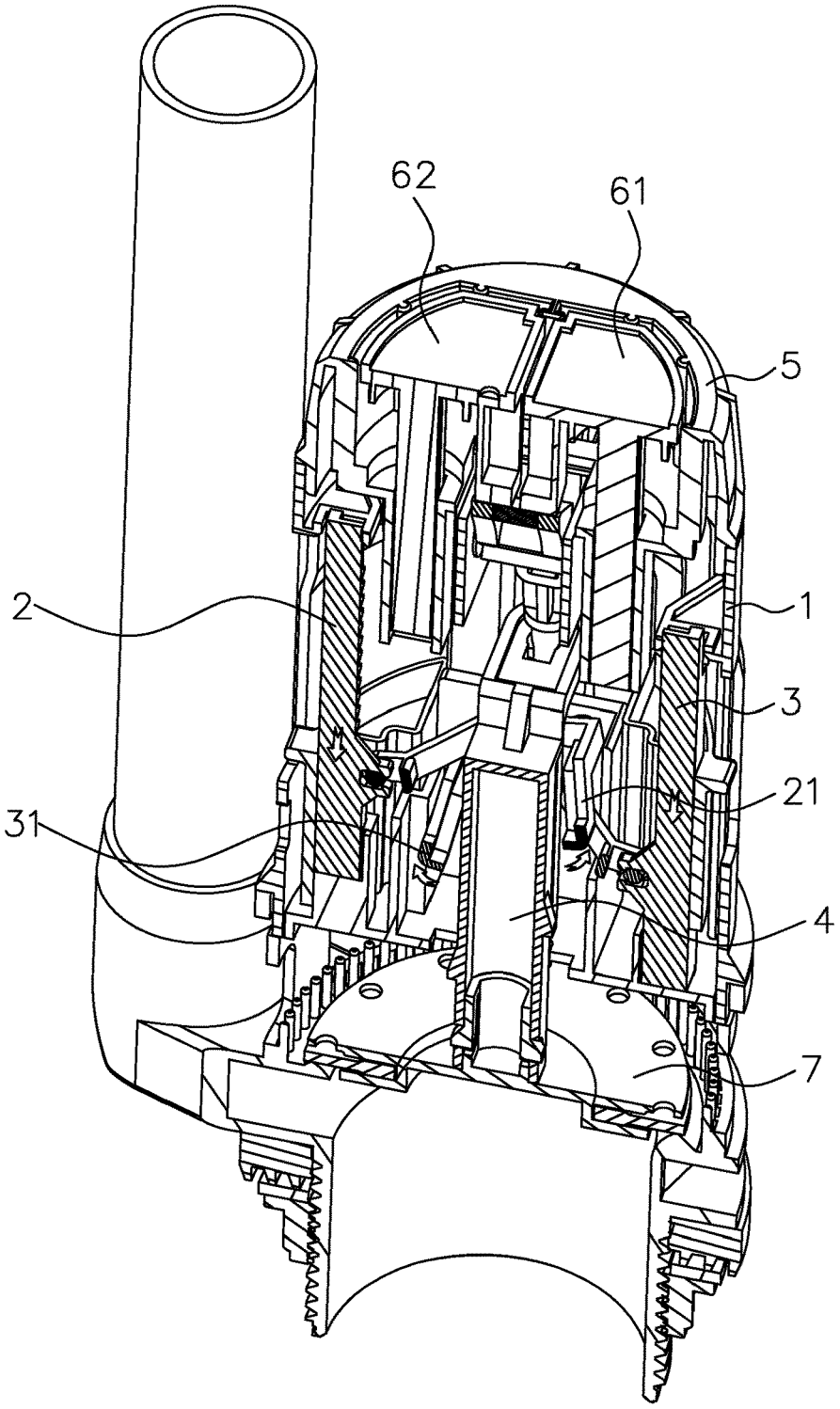
FIG. 4 is a cross-sectional view of the embodiment of the present invention in a dry state.
Figure 5:
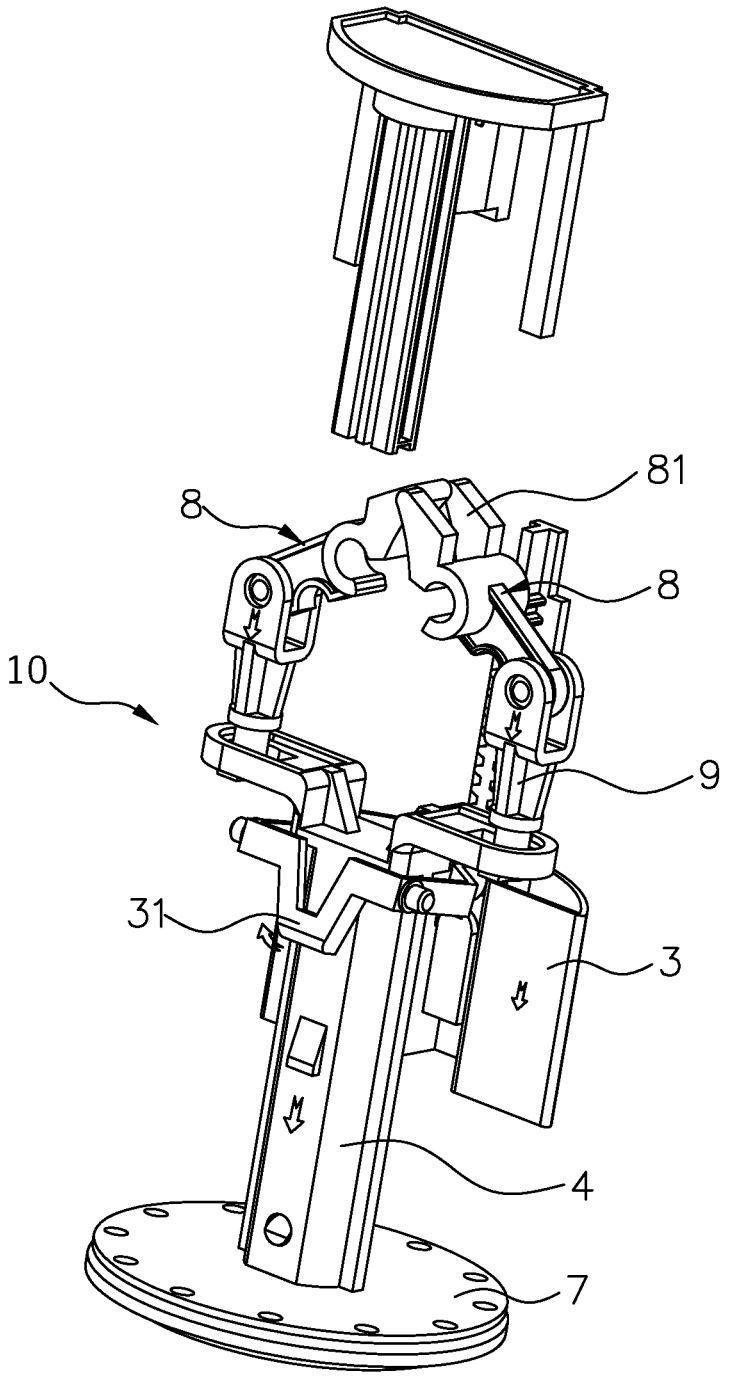
FIG. 5 is an exploded view of the embodiment of the present invention in a dry state, showing the states of a full drainage float and full drainage support.
Figure 6:
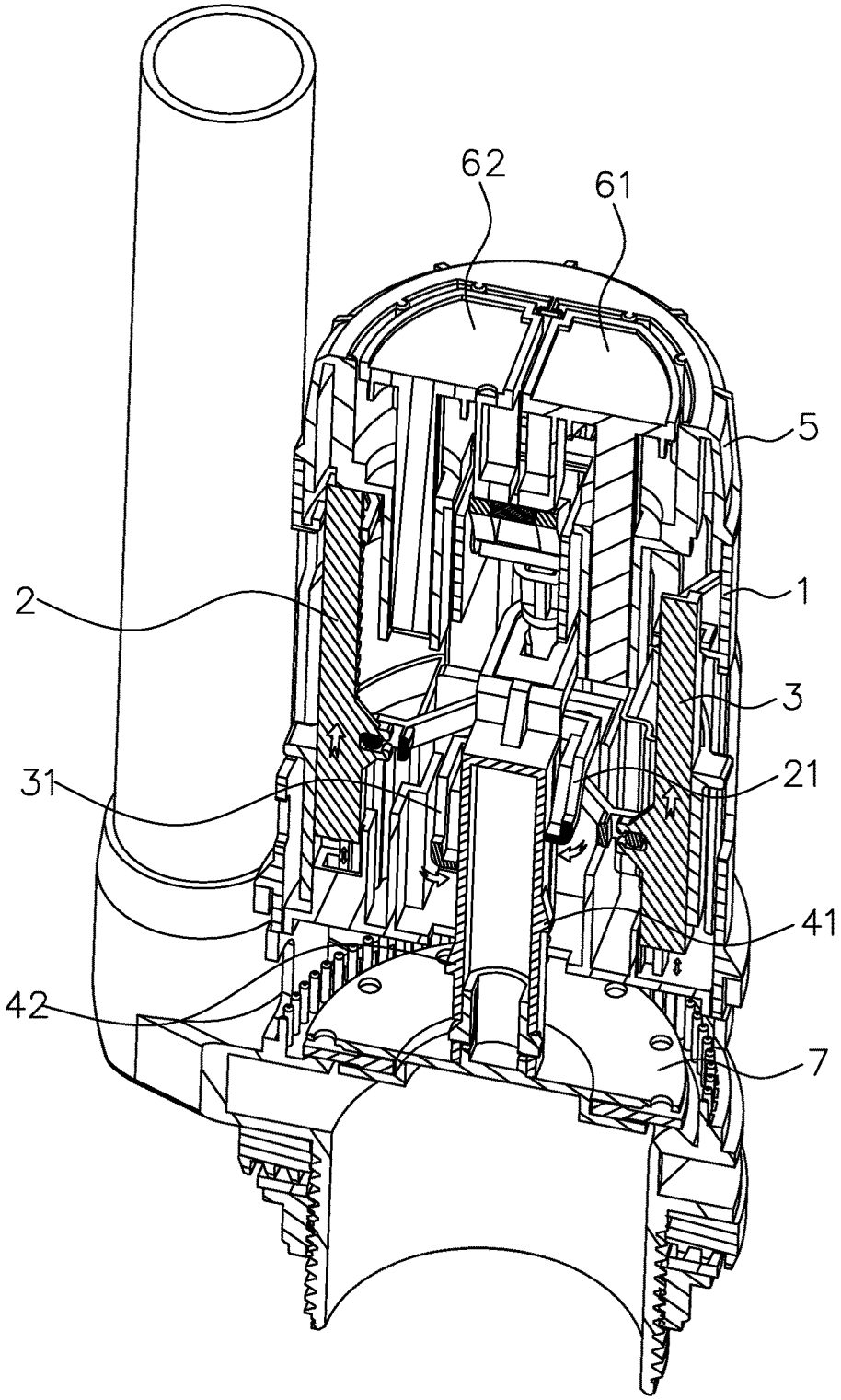
FIG. 6 is a cross-sectional view of the embodiment of the present invention in a water filling state.
Figure 7:
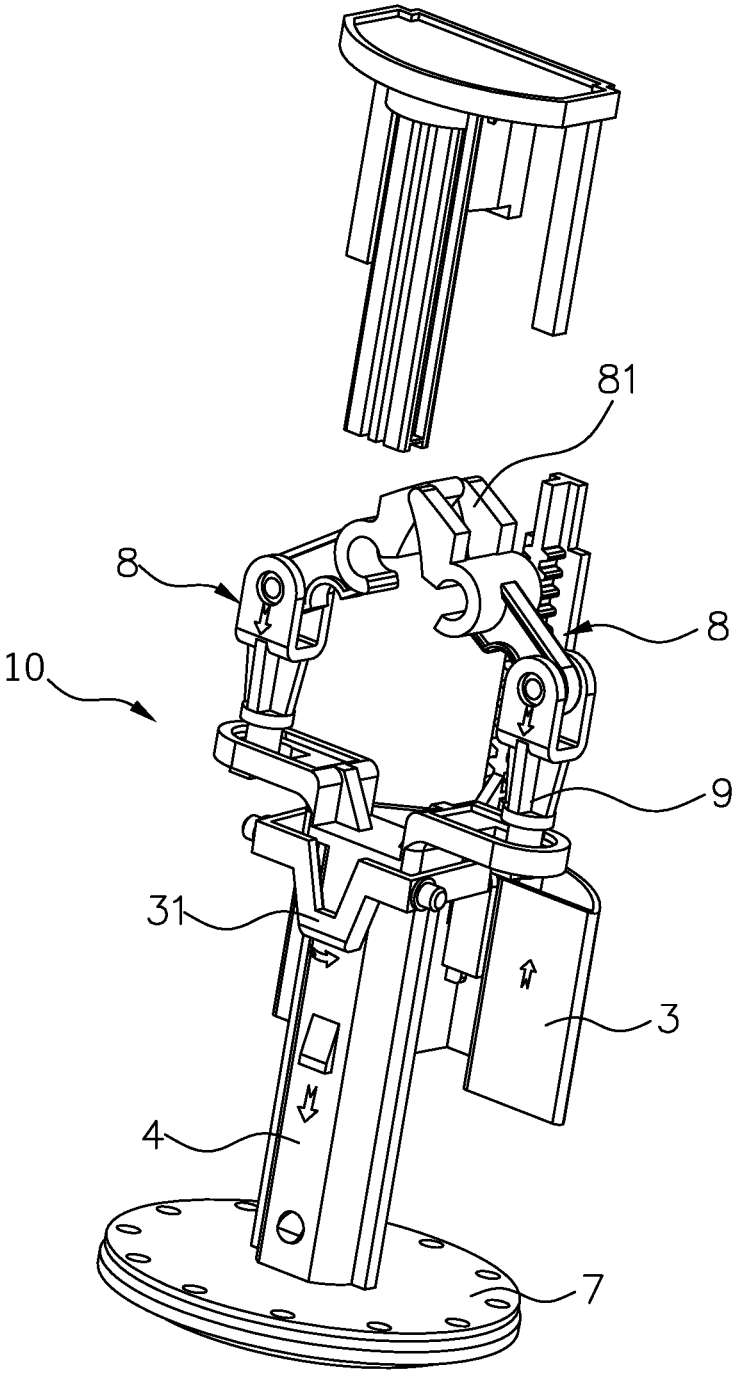
FIG. 7 is an exploded view of the embodiment of the present invention in a water filling state, showing the states of the full drainage float and full drainage support.
Figure 8:
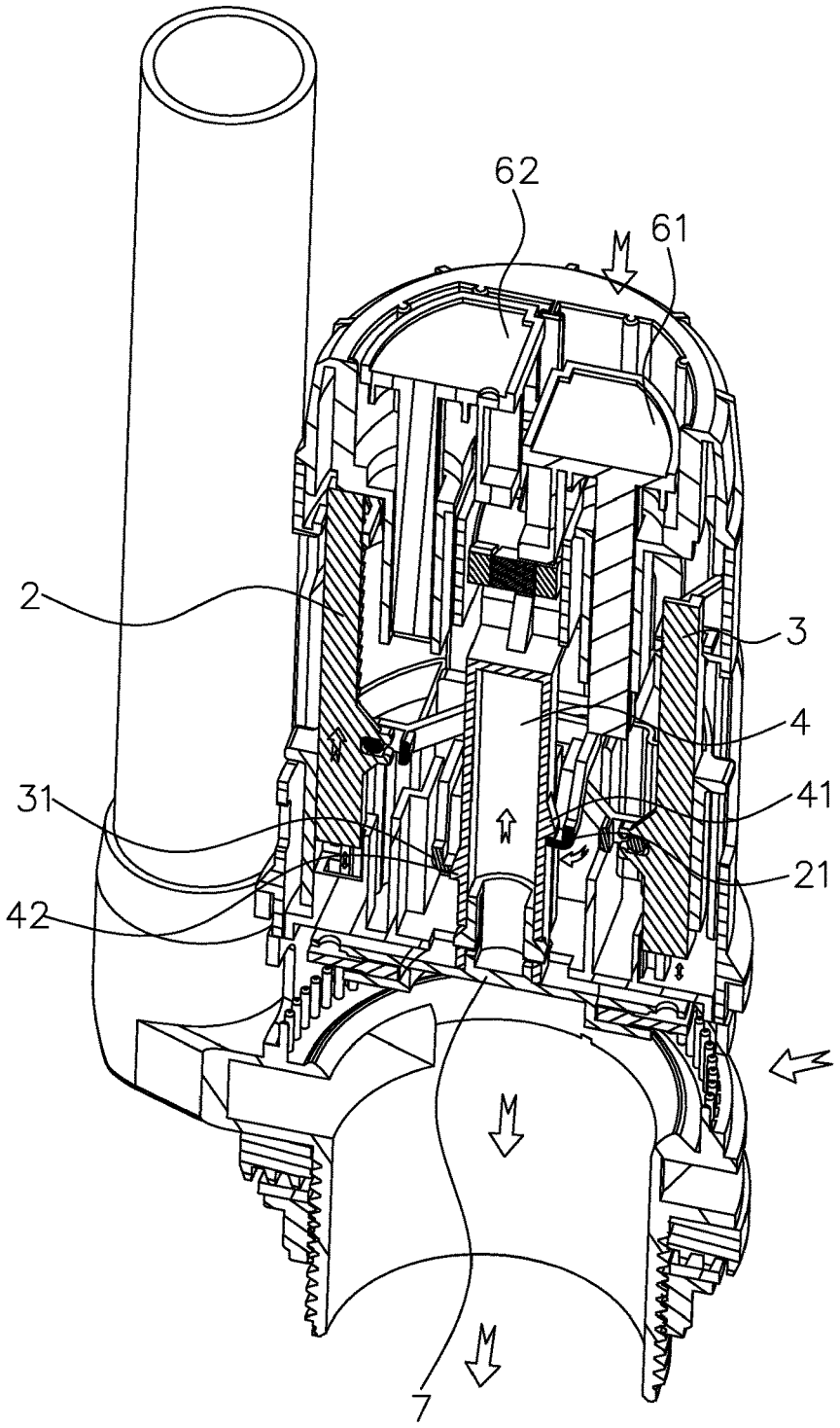
FIG. 8 is a schematically cross-sectional view of the embodiment of the present invention, showing the action of half water drainage.
Figure 9:
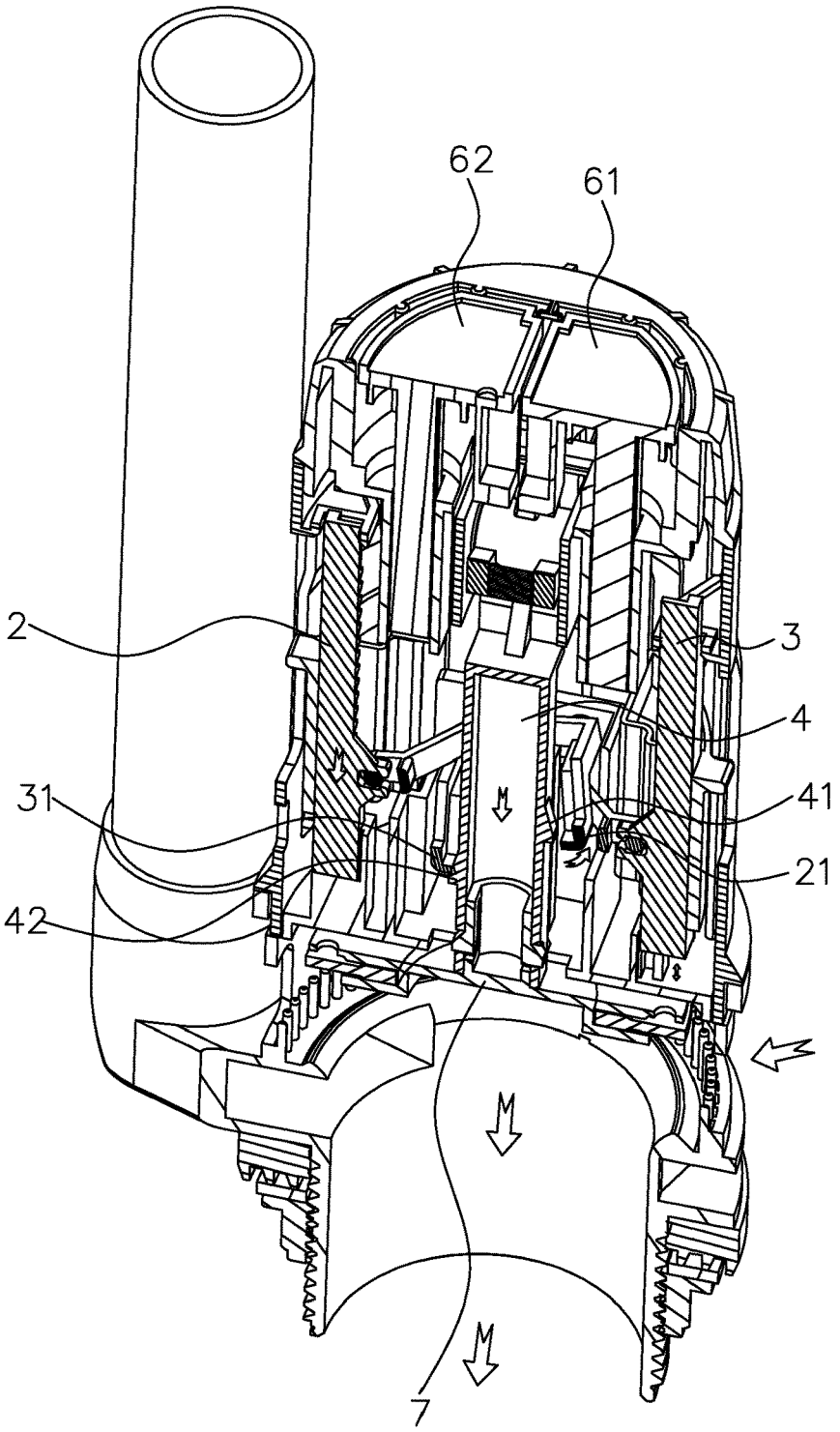
FIG. 9 is a schematically cross-sectional view of the embodiment of the present invention, showing a half water drainage state.
Figure 10:
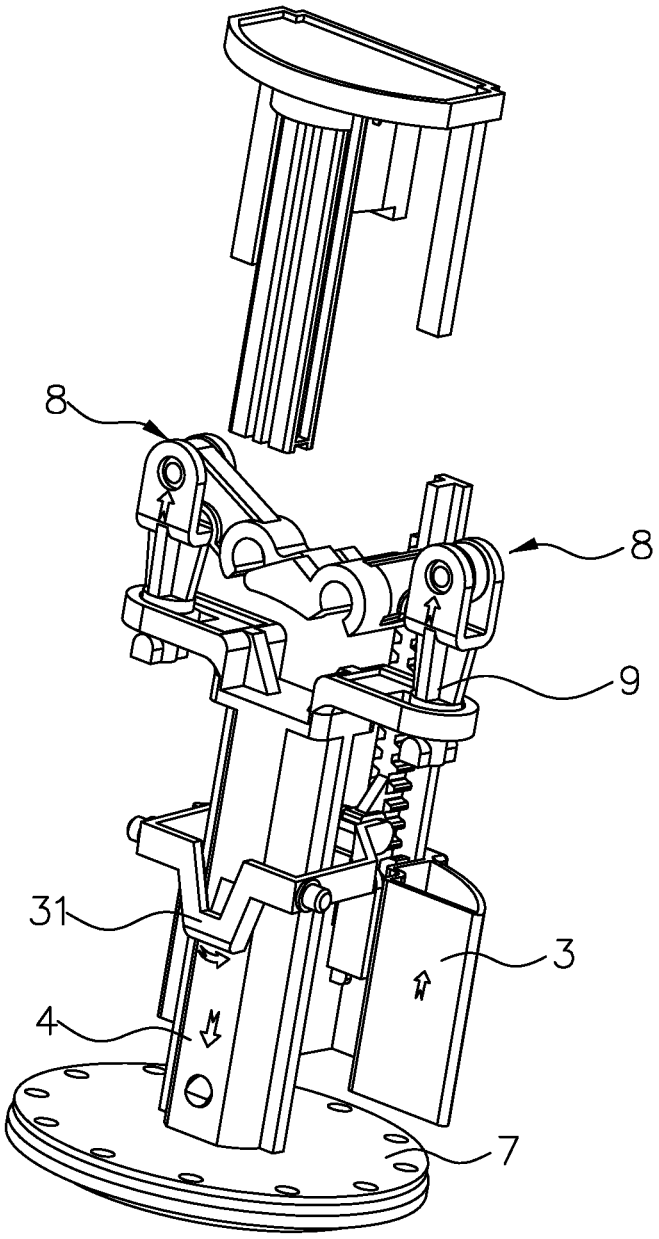
FIG. 10 is an exploded view of the embodiment of the present invention in the half water drainage state, showing the state of the full drainage float and full drainage support.

Referring to FIGS. 1 to 7, a twin water-drainage valve inner core tube starting apparatus includes a main body 1, half drainage float 2, half drainage support 21, full drainage float 3, full drainage support 31, inner core tube 4, button seat 5, half drainage button 61, full drainage button 62, water sealing sheet 7 and lever 8.

The half drainage float 2, full drainage float 3 and inner core tube 4 are mounted inside the main body 1 to form a half drainage structure and full drainage structure. The button seat 5 is mounted on the main body 1, the half drainage button 61 and full drainage button 62 are configured on the button seat 5, and a half drainage pull piece and full drainage pull piece are formed correspondingly below the half drainage button 61 and full drainage button 62.

A half drainage raised point 41 and full drainage raised point 12 are respectively formed on the inner core tube 4. Correspondingly, the half drainage support 21 is configured to be in linkage with the half drainage float 2 by means of linkages 10, and the full drainage support 31 is configured to be in linkage with the full drainage float 3 by means of linkage 10.

The water sealing sheet 7 is configured on the lower part of the inner core tube 4. At least two levers 8 arranged symmetrically are installed inside the main body 1, where one end of levers 8 is pressed against the half drainage button 61 and full drainage button 62, and another end thereof is in connection with the inner core tube 4 through a pull rod, allowing a force applied on the half drainage button 61 or full drainage button 62 is acted on the inner core tube 4 after being transmitted by the at least two levers 8 so that it is more labor-saving upon button pressing and the inner core tube 4 is not inclined any more, friction is not generated between it and other components, the pressing force is decreased, and the inner core tube 4 and other components are not damaged.

In the embodiment, the levers 8 number 2, and the two levers 8 are installed axially symmetrically in the main body 1, and one end of the levers 8 is pressed against the half drainage button 61 and full drainage button 62 and another end thereof is configured on the upper part of the inner core tube 4 through the pull rod 9. In order to prevent the half drainage pull piece and full drainage pull piece formed correspondingly below the half drainage button 61 and full drainage button 62 are not interfered while poking the two levers 8 and decrease the friction between the two levers 8, one end of one of the two levers 8 is formed into a U-typed groove, and one end of the other lever 8 is inserted in the U-typed groove 81 and then abutted against the half drainage button 61 and full drainage button 62.

The levers 8 may be set to number 3, where the three levers 8 are arranged radially and each two adjacent levers 8 are arranged symmetrically, i.e. the included angle between each two adjacent levers 8 is 120 degrees. The configuration of the three levers 8 can further increase the stability upon the lifting of the inner core tube 4 without inclination.

The levers 8 may be set to number 4, where the four levers 8 are arranged radially and symmetrically in the main body 1. The configuration of the four levers 8 can even further increase the stability upon the lifting of the inner core tube 4 without inclination.

The present invention mainly installed at least two levers 8 inside the main body 1 instead of one lever of the prior art; the levers 8 are arranged symmetrically, with one end of each lever 8 being abutted against the half drainage button 61 and full drainage button 62 and the other end thereof being in connection with the inner core tube 4 through the pull rod 9.

Referring to FIGS. 4 and 5 again, when there is no water in a tank, the half drainage float 2 and full drainage float 3 fall under the action of gravity, causing the half drainage support 21 in linkage with the half drainage float 2 and the full drainage support 31 in linkage with the full drainage float 3 to be expanded outward, i.e. moved far away from the inner core tube 4. Referring to FIGS. 6 and 7 again, when the tank is filled with water, the half drainage float 2 and full drainage float 3 rise under the action of floating force, causing the half drainage support 21 in linkage with the half drainage float 2 and the full drainage support 31 in linkage with the full drainage float 3 to be retracted, i.e. moved close to the inner core tube 4.

Figure 11:
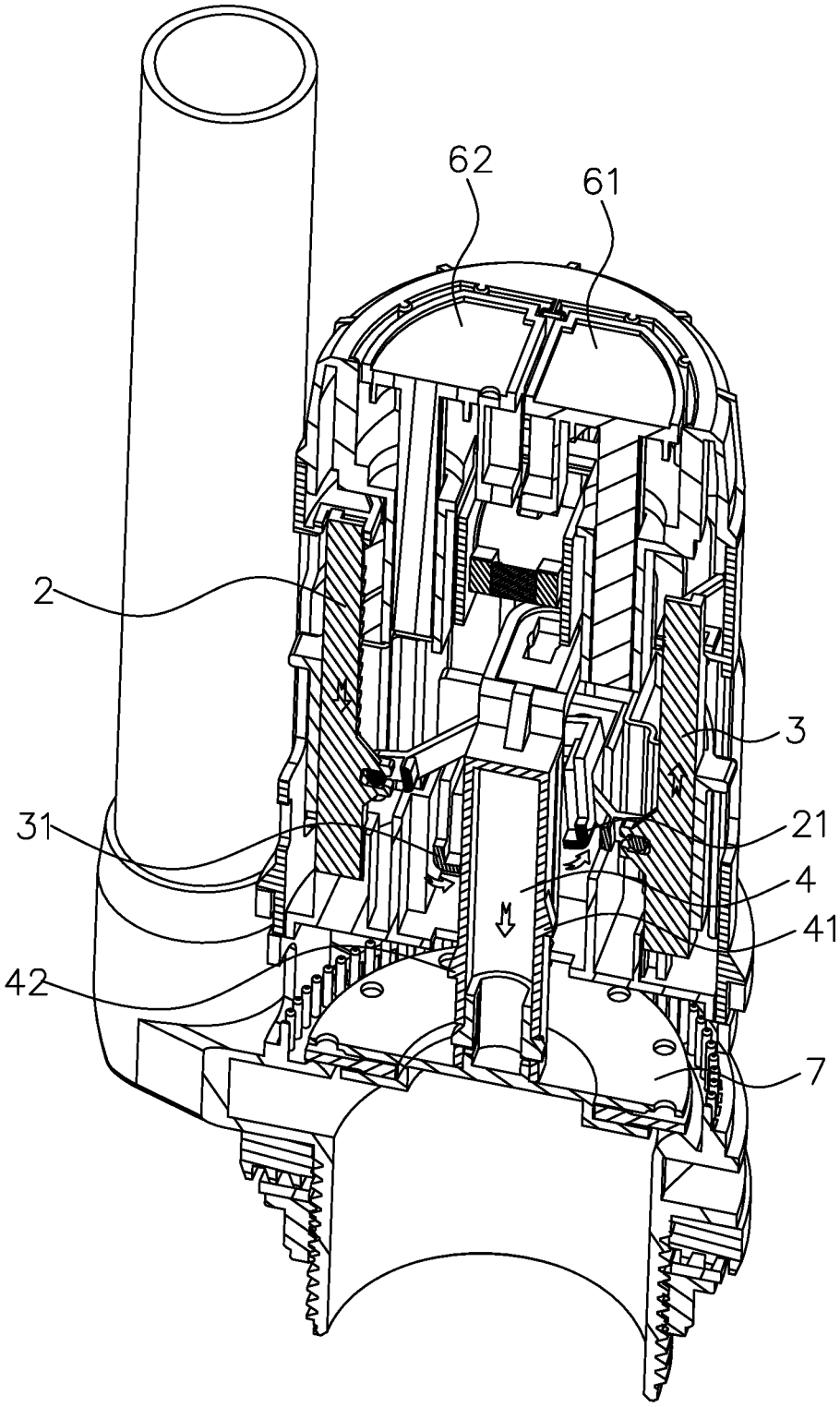
FIG. 11 is a cross-sectional view of the embodiment invention after the half water drainage.

Referring to FIGS. 8 to 11, the half drainage button 61 is pressed down, upon half water drainage, the inner core tube 4 is driven to lift upward through the at least two levers 8 until the half drainage raised point 41 is abutted against the half drainage support 21 in linkage with the half drainage float 2, and at this time, the inner core tube 4 is limited, the water sealing sheet 7 is lifted, realizing the water flushing. Thereafter, the half drainage float 2 drives the half drainage support 21 to deflect under the action of gravity, i.e. the half drainage support 21 is expanded outward when the water level is dropped to the half drainage float 2. At this time, the inner core tube 4 is free from the abutment and therefore falls to its original position as FIG. 11 shows, while the water sealing sheet 7 falls back to a drain port, and the half drainage flushing is thus completed.

Figure 12:
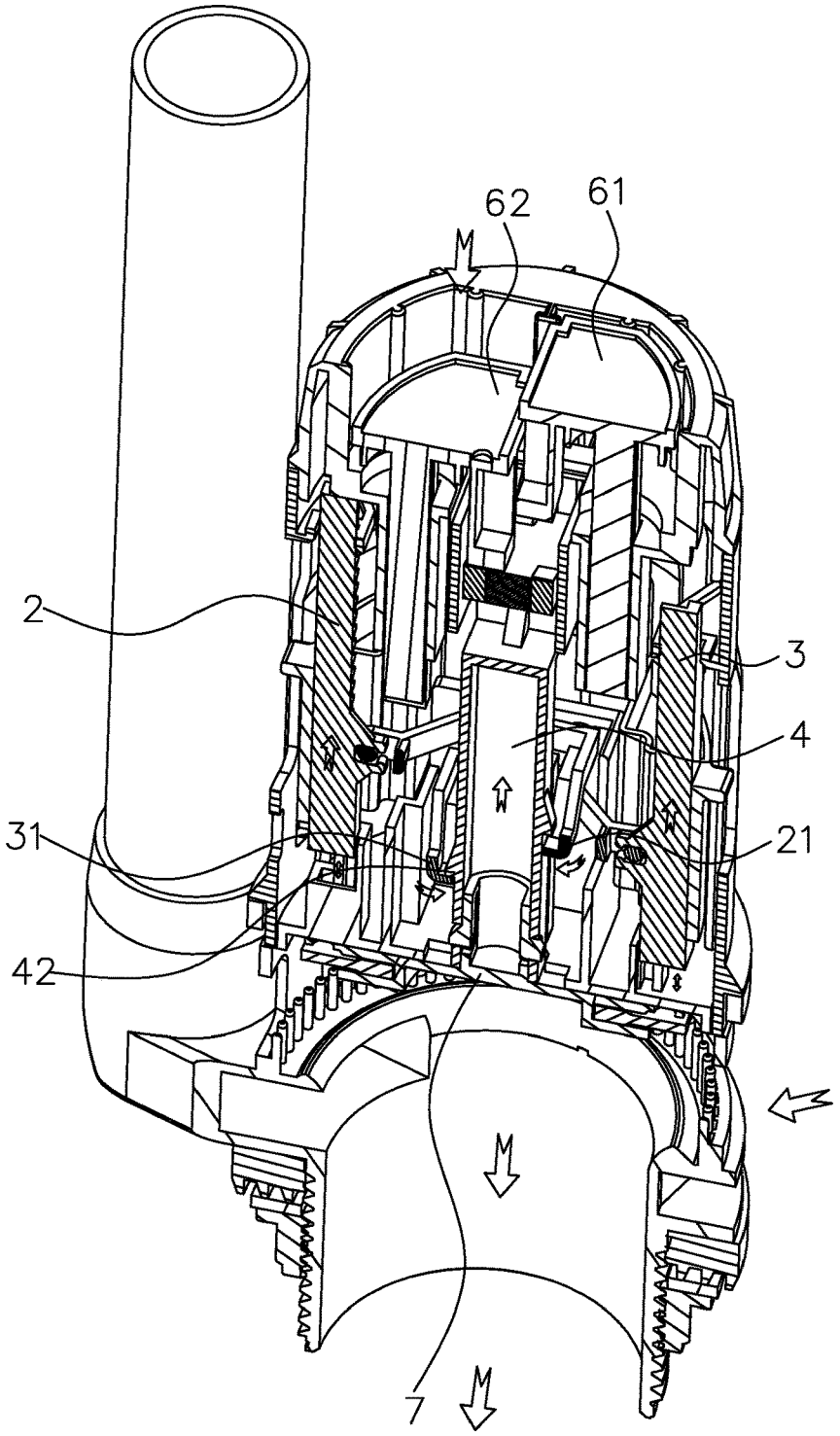
FIG. 12 is a schematically cross-sectional view of the embodiment of the present invention, showing the action of full water drainage.
Figure 13:
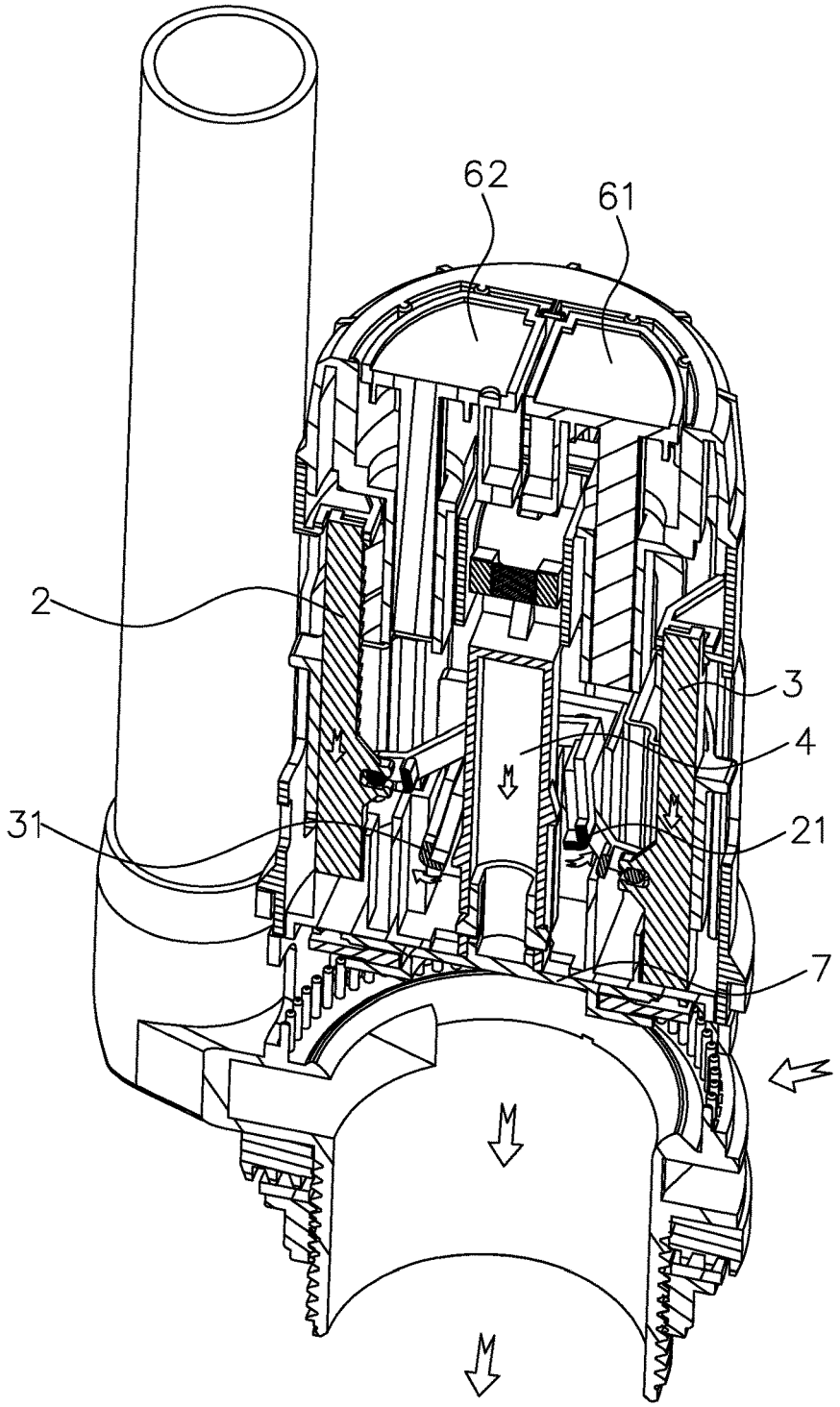
FIG. 13 is a schematically cross-sectional view of the present invention in a full water drainage state.
Figure 14:
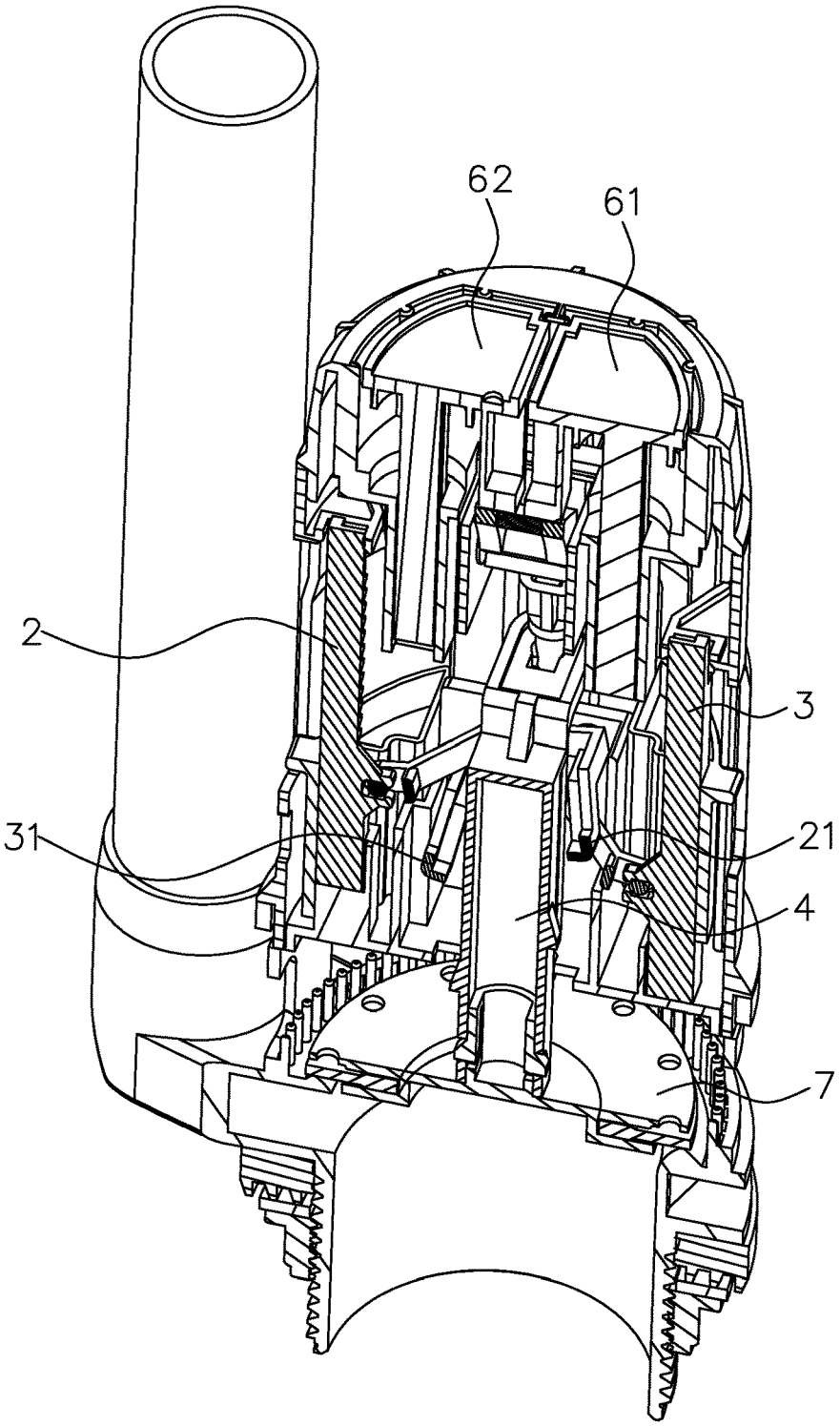
FIG. 14 is a schematically cross-sectional view of the present invention after the full water drainage.

Referring to FIGS. 12 to 14, the full drainage button 62 is pressed down, upon full water drainage, the inner core tube 4 is driven to lift upward through the at least two levers 8 until the full drainage raised point 42 is abutted against the full drainage support 31 in linkage with the full drainage float 3, and at this time, the inner core tube 4 is limited, the water sealing sheet 7 is lifted, realizing the water flushing. Thereafter, the full drainage float 3 drives the full drainage support 31 to deflect under the action of gravity, i.e. the full drainage support 31 is expanded outward when the water level is dropped to the full drainage float 3. At this time, the inner core tube 4 is free from the abutment and therefore falls to its original position as FIG. 14 shows, while the water sealing sheet 7 falls back to the drain port, and the full drainage flushing is thus completed.

I claim:

1. A twin water-drainage valve inner core tube starting apparatus adapted to be mounted in a water tank containing water therein, the twin water-drainage valve inner core tube starting apparatus comprising a button seat, a main body fixed in the water tank, a half drainage button, a full drainage button, a half drainage float, a full drainage float, an inner core tube, and a lever system, wherein the half drainage float, the full drainage float and the inner core tube are arranged inside said main body to form a half drainage structure and a full drainage structure; the button seat is mounted on said main body, and the half drainage button and the full drainage button are mounted on said button seat; the lever system comprises two levers arranged inside said main body, each lever having an upper end and a lower end, each upper end being in abutment with both the half drainage button and the full drainage button, each lower end being connected to the inner core tube;

wherein the full drainage float and the half drainage float are respectively and operatively coupled by linkages to a full drainage support and a half drainage support, the full drainage support and the half drainage support being movably mounted inside the main body and are respectively and selectively engageable with a full drainage raised point and a half drainage raised point provided on the inner core tube to selectively retain the inner core tube at a full drainage position and a half drainage position where water is allowed to discharge from water tank to cause movements of the full drainage float and the half drainage float, wherein the inner core tube is releasable from the full drainage position and the half drainage position through the movements of the full drainage float and the half drainage float, respectively, wherein operation of the linkages breaks the engagement of the full drainage support and the half drainage support with the full drainage raised point and the half drainage raised point provided on the inner core tube;

wherein depression of the full drainage button causes the two levers to operate simultaneously to move the inner core tube in an upward direction to the full drainage position to be retained in the full drainage position by means of engagement between the full drainage raised point of the inner core tube and the full drainage support and depression of the half drainage button causes the two levers to operate simultaneously to move the inner core tube in the upward direction to the half drainage position to be retained in the half drainage position by means of engagement between the half drainage raised point of the inner core tube and the half drainage support.

2. The apparatus according to claim 1, wherein the inner core tube has a central axis and the two levers are arranged symmetrically with respect to the central axis of the inner core tube.

3. The apparatus according to claim 2, wherein the upper end of a first of the two levers is formed with two lugs that are spaced from each other to form a U-shaped groove and the upper end of a second of the two levers is inserted into the U-shaped groove such that the upper ends of the first and second levers are both in abutment with the half drainage button and full drainage button.

4. The apparatus according to claim 1, wherein each lower end of the two levers is connected to the inner core tube by an associated pull rod.

* * * * *